United States Patent [19]

Ichiyanagi et al.

[11] 4,144,838

[45] Mar. 20, 1979

[54] COATING APPARATUS

[75] Inventors: Takashi Ichiyanagi; Takashige Akiyama, both of Hirakata; Ichizo Otoda, Ikeda, Japan

[73] Assignee: Matsushita Electric Industrial Co., Ltd., Kadoma, Japan

[21] Appl. No.: 784,773

[22] Filed: Apr. 5, 1977

[30] Foreign Application Priority Data

Apr. 15, 1976 [JP] Japan ..... 51-43123

[51] Int. Cl.[2] ..... B05C 3/12

[52] U.S. Cl. ..... 118/125

[58] Field of Search ..... 118/125, 404, 405, DIG. 18; 427/356, 357, 358

[56] References Cited

U.S. PATENT DOCUMENTS

| | | | |
|---|---|---|---|
| 2,647,488 | 8/1953 | Shive | 118/405 X |
| 2,868,159 | 1/1959 | Lit et al. | 118/125 |
| 3,227,577 | 1/1966 | Baessler et al. | 118/405 X |
| 3,402,696 | 9/1968 | Richards | 118/125 |
| 3,780,698 | 12/1973 | Schreiner et al. | 118/125 |
| 3,882,819 | 5/1975 | Skeeters | 118/405 |
| 3,944,459 | 3/1976 | Skobel | 118/125 X |

*Primary Examiner*—Wm. Carter Reynolds

*Attorney, Agent, or Firm*—Wenderoth, Lind & Ponack

[57] ABSTRACT

A die coating apparatus for applying coating solution onto materials such as wires. The apparatus includes a radial bearing in a position adjacent and prior to a floating die with respect to the advancing direction of the material to be coated, so that the material to be coated after having passed through the coating solution is passed through the radial bearing before advancing into the floating die. Thus, the undesirable lateral vibration of the material to be coated at the floating die is prevented and a coating film of uniform thickness is obtained on the material to be coated.

3 Claims, 23 Drawing Figures

FIG. 14 (a) Prior Art
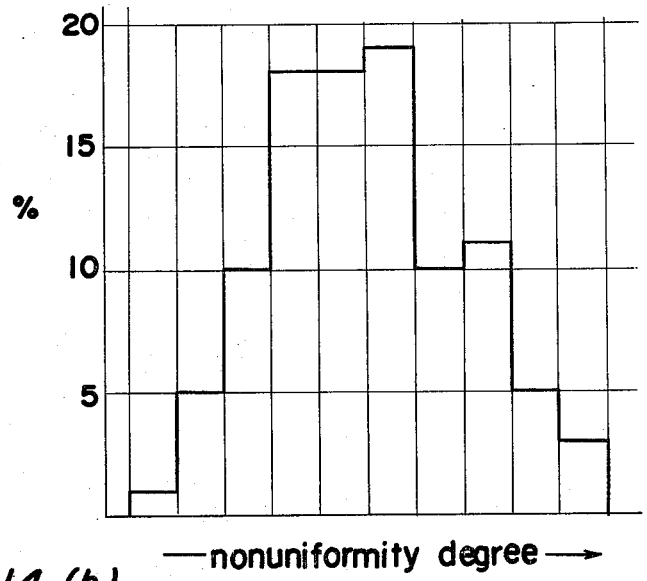
FIG. 14 (b)
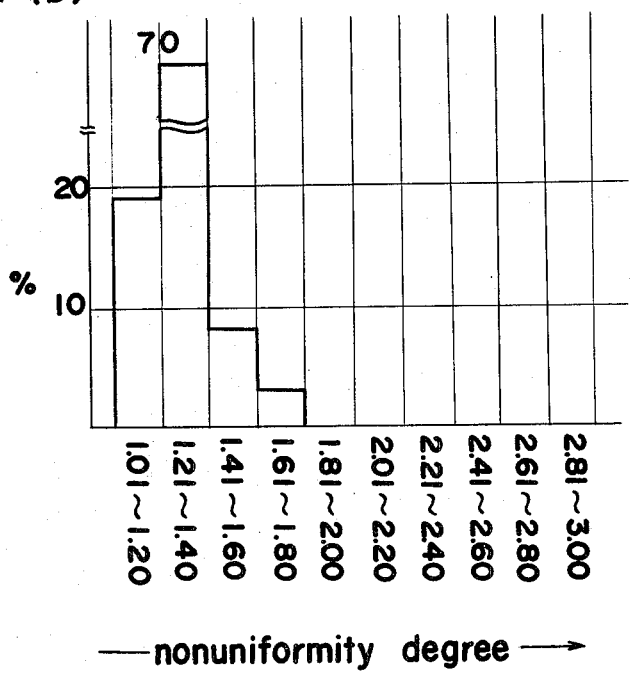

COATING APPARATUS

The present invention relates to a coating apparatus and more particularly, to a die coating apparatus for uniformly applying a viscous coating solution or coating compound onto external surfaces of materials to be coated, for example, bare wires and the like, so as to form coating films on such materials.

BACKGROUND OF THE INVENTION

Conventionally, when a viscous coating solution of resinous materials having electrically insulative propenties such as polyvinyl formal, polyester, varnish or the like is to be applied uniformly onto the external surfaces of, for example, bare wires with a coating apparatus as shown in FIGS. 1 and 2, the bare wire 2 is moved vertically upward in the direction of the arrow A through the coating solution 3 accommodated in a pot or container 1. With part of the solution 3 adheres to the outer surface of the wire 2 by the viscocity thereof and is carried upward together with the advancing wire 2. Also, while the same wire 2 passes through a through-opening 4*o* formed in a floating die 4 which is kept floating on the coating solution 3. The through-opening 4*o* gradually narrows in the direction of advance of the wire 2 for squeezing off extra coating solution 3 and thereby form a coating film 5 of uniform thickness on the surface of the wire 2.

In the arrangement as described above, the floating die 4 remains floating on the portion 3*a* of the coating solution 3 picked up by the wire 2 by balancing the viscous shearing force developed through the portion 3*b* of the coating solution located at a narrowed portion or squeezing opening 4*b* of the through opening 4*o* and the weight of the floating die 4 due to the relative speed between the die 4 and wire 2, and is employed for uniform application of the coating solution 3 onto the outer surface of the wire 2 based on effects as described hereinbelow.

On the assumption that the axis of the wire 2 goes out of alignment with that of the squeezing opening 4*b*, with consequent nonuniformity in the clearance between the wire 2 and the opening 4*b*, for example, with the clearance $\delta_1$ at the left being smaller than the clearance $\delta_2$ at the right as shown in FIG. 2(*a*), internal pressure which develops at the portions 3*a* and 3*b* of the coating solution 3 in the floating die 4 is larger at the small clearance $\delta_1$ side (at the left side) than at the large clearance $\delta_2$ side (at the right side) as shown by the arrows l and r in FIG. 2(*a*). The difference in the pressure therebetween moves the die 4 in the direction of the arrow by a force F so as to automatically restore the coaxial relation of the wire 2 with respect to the squeezing opening 4*b* of the floating die 4.

In the conventional arrangement described above, however, even if the force F is exerted when the coaxial relation is lost, there is a limit in the followup performance of the floating die 4 with respect to the movement of the wire 2 due to time-lag arising from the interia force because of the mass of the floating die 4, thus it is still difficult to uniformly apply the coating solution onto the wire 2. One example of the disadvantages as described above is shown in a chart of FIG. 3 in which the distribution of the degree of nonuniformity of the coating film 5 applied onto the wire 2 by means of the conventional apparatus is given. In the chart of FIG. 3*a*, coating solution of polyvinyl formal was applied separately six times onto a copper wire of 0.6 mm in diameter by the conventional arrangement as described above with reference to FIGS. 1 and 2, and the degree of nonuniformity of the applied coating solution was obtained through division of the maximum film thickness by the minimum film thickness, with the copper wire being cut at an interval of 10 m to obtain 100 samples therefrom. As a result, the degree of nonuniformity degree was 1.46 on the average, with a standard deviation of 0.71: thus indicating the importance of preventing lateral vibration of the wire 2 with respect to its advancing direction. Various proposals have been made for improvements.

Referring to FIG. 4 showing an entire arrangement of the conventional coating apparatus or coating solution applying and stoving apparatus for wires, the wire 2 is directed around a direction change pulley P3 at a feeding side, a lower pulley P1, an upper pulley P2 and onto a winding drum D. The wire 2 is stretched at a predetermined tension between the pulleys P1 and P2 and passes through the container or coating solution bath 1 having the coating solution 3 accommodated therein, the floating die 4, and a stoving furnace F sequentially positioned between the pulleys P1 and P2. The same wire 2 advances in the direction of the arrow A at a speed of approximately 10 to 20 m/min following rotation of the pulleys P1 to P3 and the drum D. In such a conventional arrangement as described above, the undesirable lateral movements of the wire 2 at its portion 2*a* in the floating die 4 are found to be attributable to four major causes as described hereinbelow.

(1) In FIG. 4, the pulleys P1 and P2 tend to deviate from perfect circular motion due to manufacturing errors of the same pulleys P1 and P2, and errors in assembling the pulleys P1 and P2 and their rotational shafts $P_{1s}$ and $P_{2s}$. Accordingly, a contact-terminating point C1 between the wire 2 and the pulley P1 is liable to move in a direction normal to the advancing direction of the wire 2, while a contact-initiating point C2 between the wire 2 and the pulley P2 similarly tends to move in a direction normal to the advancing direction of the wire 2, thus resulting in the lateral vibration of the wire portion 2*a* in the floating die 4. In order to overcome the above inconveniences, fitting the shafts $P_{1s}$ and $P_{2s}$ perfectly perpendicularly to the pulleys P1 and P2 respectively and improving the eccentricity of the shafts $P_{1s}$ and $P_{2s}$ with respect to the pulleys P1 and P2 may be effective, but an increased manufacturing cost is inevitable in such accuracy improvements. Furthermore, if wires having different diameters are to be coated by the same coating apparatus, it is necessary to prepare pulleys suited to the diameters of the wires for replacement.

(2) There are cases where the lateral vibration of the wire portion 2*a* results from variations in the tension of the wire 2 between the pulleys P1 and P2 due to lack of smooth rotation of the pulleys P1 to P3 and winding drum D. For eliminating the disadvantages as described above, various countermeasures such as driving the winding drum D by a torque motor (not shown) to maintain the tension of the wire 2 constant or urging a roller R against the portion 2*b* of the wire 2 between the pulleys P1 and P3 by spring means S to obtain the constant tension have been proposed, but each of these countermeasures cannot fully cope with rapid variations in the tension due to the inertia force resulting from the large mass of the pulleys P1 and P2 and the wire 2, and thus giving rise to the undesirable lateral vibration of the wire 2.

(3) The apparatus of FIG. 4, is arranged so that, after the coating solution 3 prepared by solving polyester, polyvinyl formal and the like into an organic solvent has been applied onto the wire 2, the organic solvent is evaporated in the stoving furnace F to leave the solids content on the wire 2 for the formation of the coated film 5, and therefore the ratio of the solids content to the organic solvent must be kept constant for a long period of time to (a) maintain the amount of the coated film 5 constant and (b) prevent the floating die 4 from varying in its buoyancy due to any viscosity alteration in the coating solution 3. Meanwhile, as shown in FIG. 5, the coating solution 3 contained in the container 1 tends to condense, since the organic solvent evaporates from the surface 3*f* of the coating solution 3. To prevent such condensation, fresh coating solution 3*u* a constant mixing ratio of the solids content to the organic solvent is constantly supplied through an inlet 1*i* of the bath or container 1 to cause the solution 3*u* to pass through the bath 1 in a direction as shown by the arrows a before being discharged through an outlet 1*o*. In which case, the fresh coating solution 3*u* tends to flow with pulsation and impart a lateral pulsating force to the wire 2, thus inducing the undesirable lateral vibration in the wire 2.

(4) Furthermore, as shown in FIG. 6, the circulating currents of the solution 3 flowing in the direction of the arrows b are developed in the bath 1 due the viscosity of the coating solution 3 when the wire 2 passes through the bath 1. These circulating currents are extremely sensitive to the variations of viscosity caused by the non-uniform temperature in the coating solution 3; therefore, it is quite difficult to obtain uniform circulating currents even when a heater means Ha provided with a thermostat is disposed in the bath 1, and the lateral vibration of the wire 2 induced by such ununiform circulating flow is appreciably large.

(5) Referring back to FIG. 4, the wire 2 with the coating solution 3 at the portion 3*a* of the solution passes through the stoving furnace F so that the coating solution 3 applied onto the wire 2 solidifies with the solvent component thereof evaporated; in which case, the air within the furnace F heated by heater means Hf provided in the furnace F forms an upward flow as shown by the arrows c in FIG. 7. This upward flow of the air also induces the lateral vibration of the wire 2.

As is seen from the foregoing description, in the conventional coating solution-applying apparatuses, even when the floating die 4 is adopted to automatically follow up the lateral vibration of the wire 2, it is impossible to avoid unevenness of the coated film 5 as described earlier with reference to FIG. 3.

SUMMARY OF THE INVENTION

Accordingly, an essential object of the present invention is to provide a coating apparatus of the die coating type which is capable of evenly applying a coating solution onto the external surfaces of materials, such as wires, with substantial elimination of the disadvantages inherent in this conventional coating apparatuses of the type.

Another important object of the present invention is to provide a coating apparatus of the above-described type in which the material to be coated is advantageously prevented from lateral vibration during application of the coating solution so as to be formed with a uniform film coating thereon.

A further object of the present invention is to provide a coating apparatus of the above-described type which is simple in construction, accurate in functioning, and can be manufactured at low cost.

In accomplishing these and other objects, according to one preferred embodiment of the present invention, the coating solution-applying apparatus includes a floating die which has a through-opening gradually narrowed in the direction of advance of the material, such as a wire, to be coated for allowing the material after having passed through the coating solution to pass therethrough, and a radial bearing fixedly disposed in a position prior to said floating die with respect to the advancing direction of the material to be coated so that the same material to be coated passes through the floating die after passing through the radial bearing. By this arrangement, the material to be coated is advantageously restircted, through lubricating material, in its movement in the radial direction by the radial bearing disposed in the vicinity of the floating die. Thus, the undesirable lateral vibration of the material to be coated at the floating die is positively prevented, and a uniform thickness of the film coating formed on the material to be coated is obtained.

BRIEF DESCRIPTION OF THE DRAWINGS

These and other objects and features of the present invention will become apparent from the following description taken in conjunction with the preferred embodiment thereof with reference to the attached drawings, in which:

FIG. 2(*b*) is a schematic top plan view showing the relation between the material to be coated and the floating die employed in the conventional coating apparatus of FIG. 2(*a*);

FIG. 10(*c*) is a diagram similar to FIGS. 10(*a*) and 10(*b*), but particularly illustrates the effect according to the arrangement of the present invention;

FIG. 11(*b*) is a view similar to FIG. 11(*a*), but particularly illustrates the effect according to the arrangement of the present invention;

FIG. 14(*a*) is a chart similar FIG. 13, but particularly shows the degree of nonuniformity of the coating film formed by the conventional coating apparatus of FIG. 4 when the pulleys are displaced in the direction normal to the material to be coated;

FIG. 14(*b*) is a chart similar to FIG. 14(*a*), but particularly shows the degree of nonuniformity of the coating film formed by the coating apparatus of the present invention under the same condition as in FIG. 4(*a*);

FIG. 15(*b*) is a schematic top plan view of the bearing of FIG. 15(*a*); and

FIG. 15(*c*) is a chart showing pressure distribution in the bearing of FIG. 15(*a*).

DETAILED DESCRIPTION OF THE INVENTION

Figure 1:
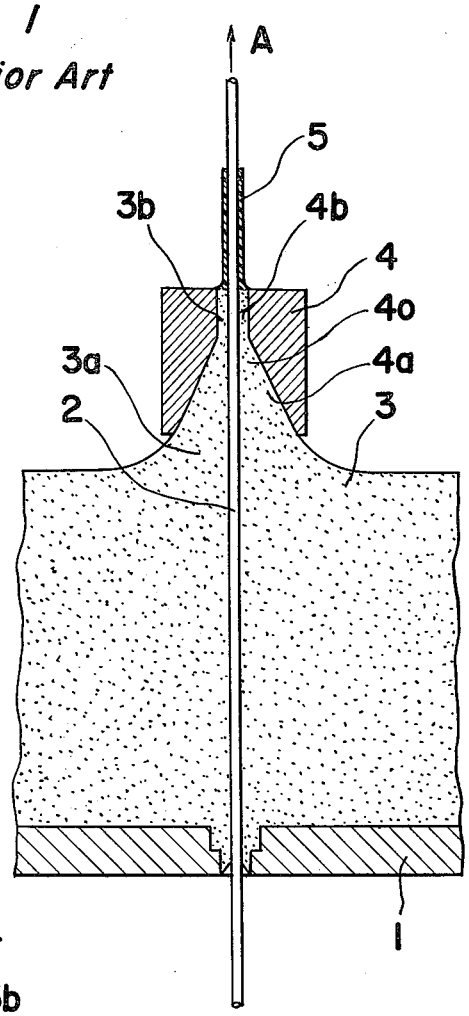
FIG. 1 Prior Art
FIG. 1 is a schematic sectional view showing an essential portion of a conventional coating apparatus.
Figure 2:
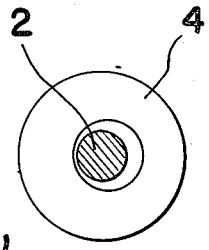
FIG. 2 (b) Prior Art
FIG. 2(*a*) is a schematic sectional view showing, on an enlarged scale, the relationship between the material to be coated and a floating die employed in the conventional coating apparatus of FIG. 1.
Figure 2:
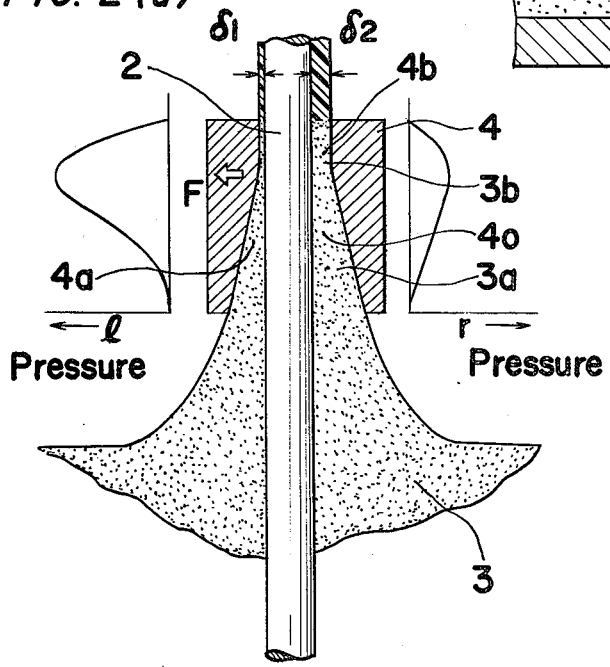

Before the description of the present invention proceeds, it is to be noted that like parts are designated by like reference numerals throughout the several views of the accompanying drawings.

Figure 8:
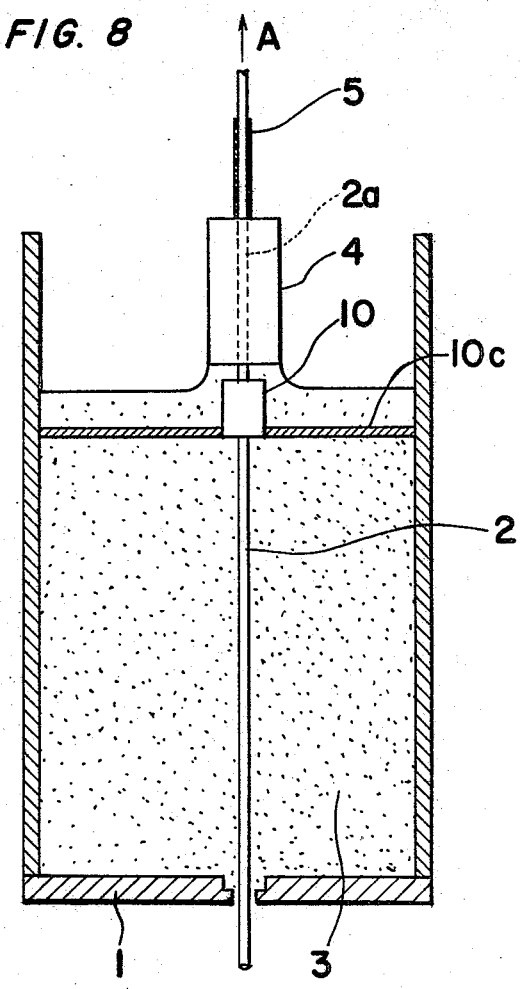
FIG. 8 is a schematic sectional view showing an essential portion of a coating apparatus according to one embodiment of the present invention.

Referring now to the drawings, there is shown in FIG. 8 a coating apparatus of the die coating type according to one preferred embodiment of the present invention which includes a floating die 4 adapted to float on the surface of the coating solution 3 of, for example, polyvinyl formal contained in a container or coating solution application bath 1 and a radial bearing 10 fixedly disposed adjacent and immediately below the floating die 4 within the container 1. The bearing 10 is suitably secured to the inner walls (not shown) of the container 1 through a support beam 10*c* fixed to the lower portion of the same bearing 10. The material, for example, the wire 2, to be coated which passes through the container 1 containing the coating solution 3 therein in the direction of the arrow A at a speed of approximately 20 m/min and enters the floating die 4 after passing through the radial bearing 10. Accordingly, the wire 2 is restricted in its movement in the radial direction by the radial bearing 10, through the lubricating material (not shown), in the vicinity of the floating die 4. It should be noted here that the floating die 4 has an internal structure similar to that of the conventional arrangement described with reference to FIG. 1 i.e., it has the gradually narrowed through opening 4*o*.

Figure 9:
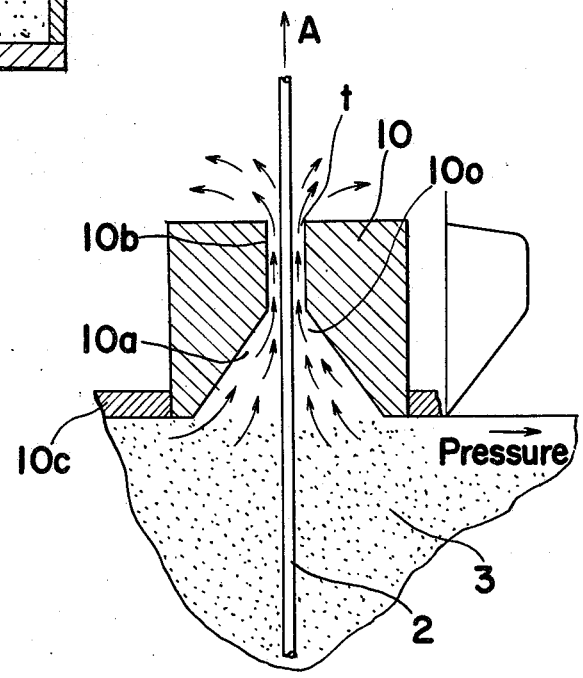
FIG. 9 is a schematic sectional view showing, on an enlarged scale, construction of a radial bearing employed in the apparatus of the present invention of FIG. 8.

Referring particularly to FIG. 9. the bearing 10 directly related to the present invention has a central through opening 10*o* which is concentric with the opening 4*o* of the floating die 4 and which includes a lower conical tapered portion 10*a*, an upper cylindrical narrowed portion 10*b*, which acts as a radial bearing through pressure due to the hydrodynamic wedge action effect developed when the coating solution 3 adheres to the surface of the wire 2 by its viscosity and flows into the tapered portion 10*a* of the through opening 10*o*. The distribution of such pressure is shown at the right hand portion of FIG. 9. The clearance t between the wire 2 and the cylindrical portion 10*b* of the opening 10*o* should be set to approximately 30$\mu$ in the case where the diameter of the wire 2 is 0.6 mm.

Figure 4:
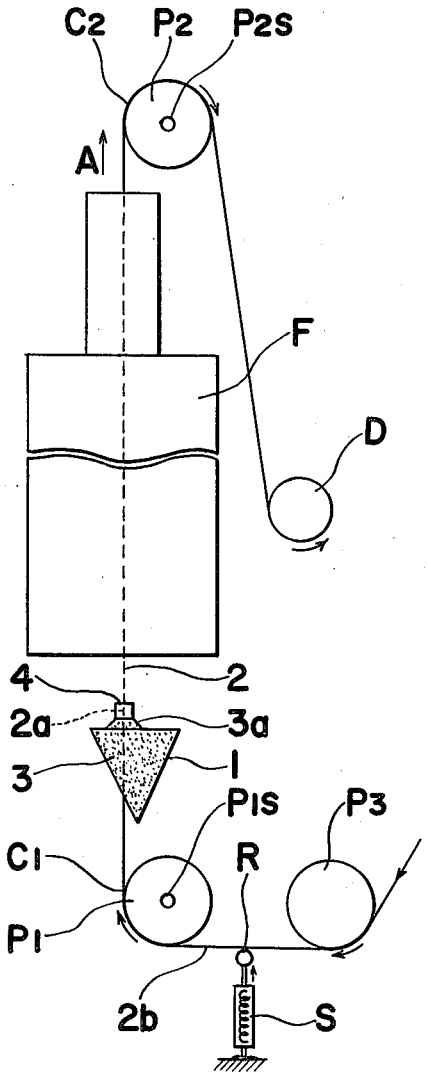
FIG. 4 Prior Art
FIG. 4 is a schematic side elevational view showing an overall arrangement of the conventional coating apparatus of FIG. 1.
Figure 5:
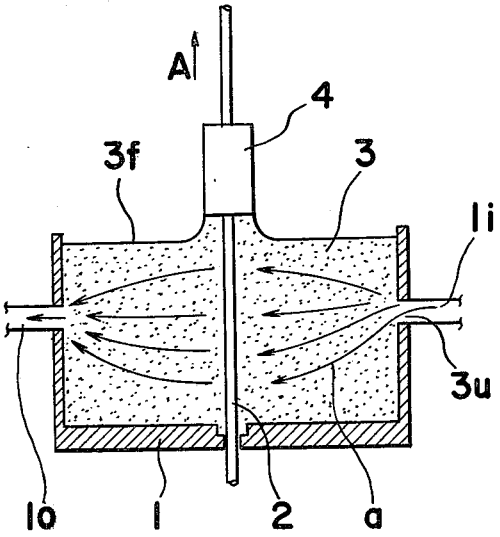
FIG. 5 Prior Art
FIG. 5 is a schematic sectional view showing, on an enlarged scale, the flow of the coating solution in a coating solution applying bath employed in the conventional arrangement of FIG. 4.
Figure 6:
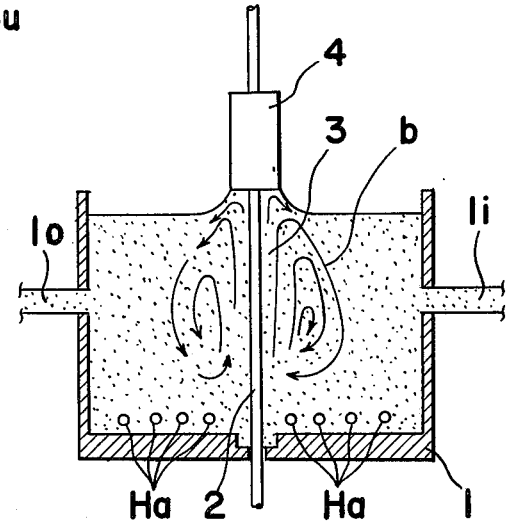
FIG. 6 Prior Art
FIG. 6 is a view similar to FIG. 5, but particularly shows the circulating flow of the coating solution in the coating solution applying-bath in the conventional arrangement of FIG. 4.
Figure 7:
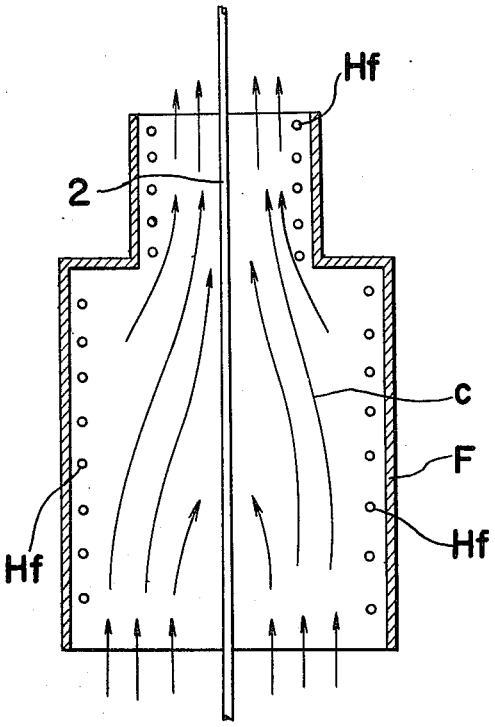
FIG. 7 Prior Art
FIG. 7 is a view similar to FIG. 5, but particularly shows an upward flow of air within a stoving furnace employed in the conventional arrangement of FIG. 4.
Figure 10:
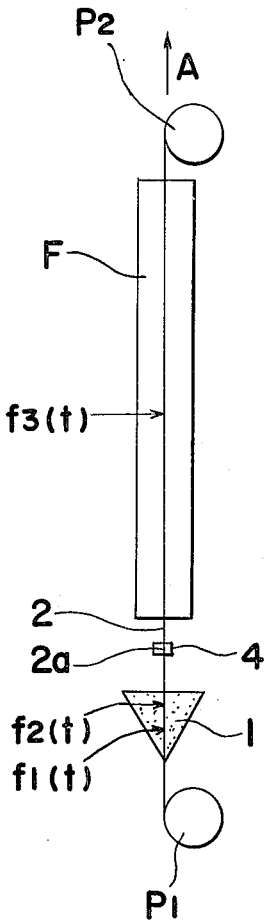
FIG. 10 (a) Prior Art
FIGS. 10(*a*) and 10(*b*) are schematic diagrams explanatory of disturbances in the coating solution applying bath in the conventional arrangement of FIG. 4.
Figure 10:
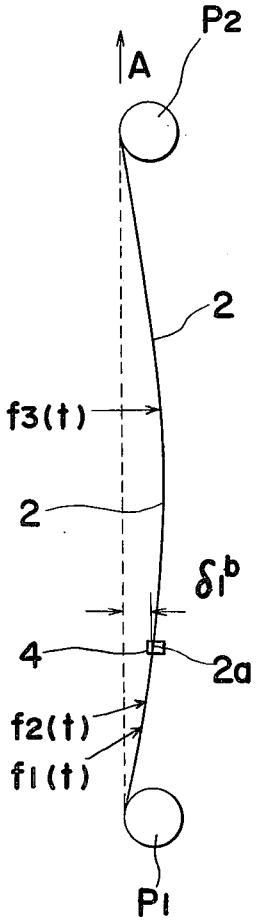
FIG. 10 (b) Prior Art
Figure 10:
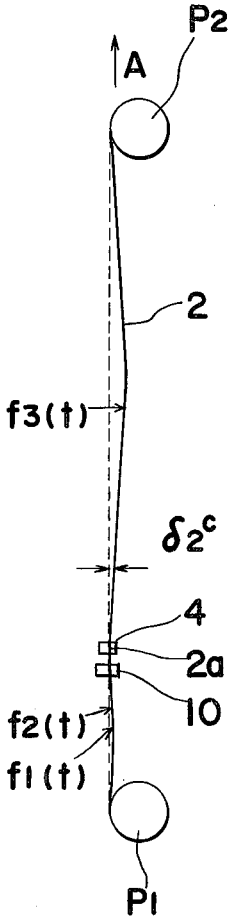

Referring now to FIGS. 10(*a*) to 10(*c*), as described with reference to FIG. 4, in the conventional arrangement of FIG. 10(*a*), the wire 2, at the portion 2*a* thereof in the floating die 4, is prevented from lateral vibration at its through the stoving furnace F, by the pulley P2 remote from the die 4, and at its other end through the coating solution applying bath 1, by the pulley P1 remote from the same die 4. Accordingly, no positive and direct countermeasures are taken to prevent vibration between the pulleys P1 and P2, and therefore, the wire 2 tends to be laterally deflected as shown in FIG. 10(*b*) (in which $\delta_1{}^b$ represents the amount of deflection (amount of displacement) of the wire portion 2*a* at the floating die 4) due to disturbances acting between the pulleys P1 and P2, i.e., the lateral fluctuating force $f_1$ (t) developed upon supplying the coating solution into the bath 1, the lateral fluctuating force $f_2$ (t) applied to the wire 2 during its advance in the direction of the arrow A due to nonuniformity of the circulating currents flowing in the direction of the arrow b in FIG. 6 through the viscosity of the coating solution, and the lateral fluctuating force $f_3$ (t) produced by the turbulence of the upward flow within the stoving furnace F.

On the contrary in the present invention, as shown in FIG. 10(*c*), even when the wire 2 is subjected to similar disturbances $f_1$ (t), $f_2$ (t) and $f_3$ (t), the amount of deflection $\delta_1{}^c$ at the portion 2*a* of the wire 2 in the floating die 4 can be suppressed to an extremely small amount in comparison to the amount of deflection $\delta_1{}^b$ in the conventional arrangement, since the wire 2 is restricted in its lateral displacement by the radial bearing 10 disposed below and adjacent the die 4.

Figure 11A:
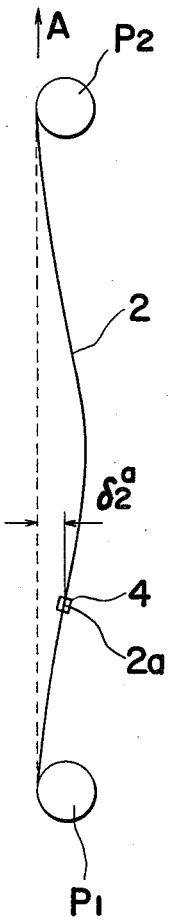
FIG. 11(a) Prior Art
FIG. 11(*a*) is a view similar to FIGS. 10(*a*) and 10(*b*), but particularly illustrates variations of the tension in the material to be coated in the conventional arrangement of FIG. 4.
Figure 11B:
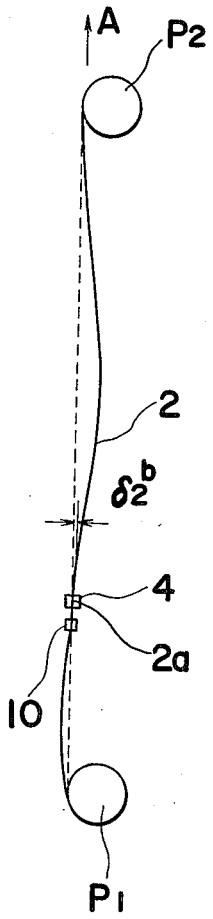

Referring also to FIGS. 11(*a*) and 11(*b*), similar to in the undesirable lateral vibration developed by the variations of tension in the wire 2 arising from ununiform rotation of the pulleys P1, P2 and P3, when a vibration mode of the lowest order is considered, a deflection mode as shown in FIG. 11(*a*) is noticed in the conventional arrangement. In the present invention provided with the radial bearing 10, on the other hand, the lateral vibration of the portion 2*a* of the wire 2 at the floating die 4 is advantageously prevented as in FIG. 11(*b*), and the deflection amount of the wire portion 2*a* at the floating die 4 is suppressed to a very small degree with the relation $\delta_2{}^b \lll \delta_2{}^a$.

Figure 12A:
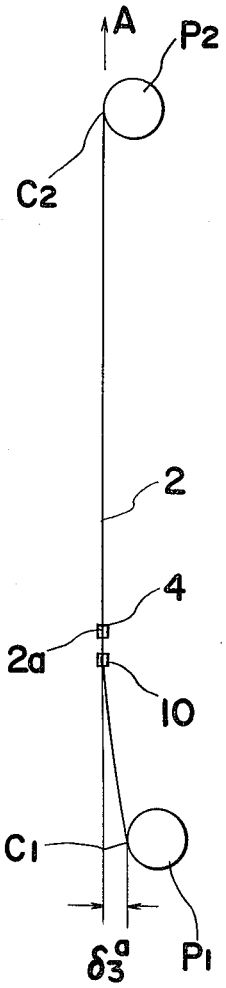
FIGS. 12(*a*) and 12(*b*) are views similar to FIG. 11(*b*), but particularly illustrate the effect of the arrangement of the present invention with respect to movements of pulleys in the direction normal to the material to be coated.
Figure 12B:
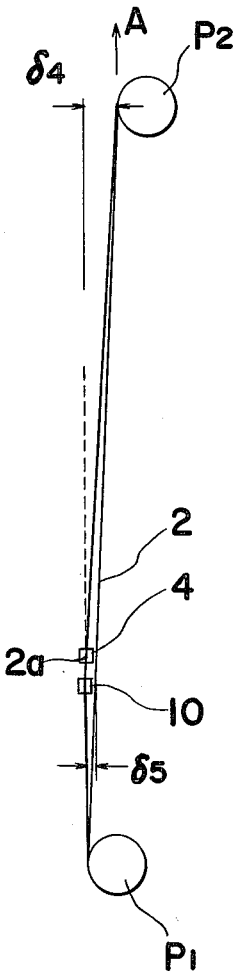

Referring to FIGS. 12(*a*) and 12(*b*), the lateral vibration at the wire portion 2*a* due to the positional deviations of the contact-terminating point C1 and contact-initiating point C2 between the wire 2 and the pulleys P1 and P2 arising from the manufacturing errors and insufficient accuracy in assembling of the pulleys P1 and P2 can also be prevented in the manner as described hereinbelow.

In FIG. 12(*a*), even on the assumption that the pulley P1 is moved by a distance $\delta_3{}^a$, the wire 2 is almost unaffected by such displacement as is seen from its geometrical relationship in which the wire 2 is held in position by the radial bearing 10, with the floating die 4 present in front of the bearing 10. Thus, the wire 2 is not subjected to the lateral movement or vibration. Meanwhile, in FIG. 12(*b*), when the pulley P2 is displaced by a distance $\delta_4$, the wire 2 will move a distance $\delta_5$ in the absence of the radial bearing 10. As is clear from the geometrical relation of FIG. 10(*c*), however, since the floating die 4 is disposed at a position close to the radial bearing 10, the displacement of the wire 2 is very small as compared with the distance $\delta_5$.

It is clear from the foregoing description that, in the arrangement according to the present invention an, extremely strong antivibration effect can be imparted to the portion 2*a* of the wire 2 at the floating die 4 against disturbances such as the nonuniform fluctuating force $f_1$ (t) developed during the replenishing of the coating solution the, nonuniform fluctuating force $f_2$ (t) caused by the viscous circulating flow of the coating solution, and the nonuniform fluctuating force $f_3$ (t) due to the upward flow of air in the stoving furnace F, as well as the lateral vibration force arising from variation of the tension in the wire 2, and the external force resulting from variations on the contacting position of the wire 2 with the pulleys etc. The application of coating solution onto the material to be coated with high uniformity is therefore, made possible.

Figure 3:
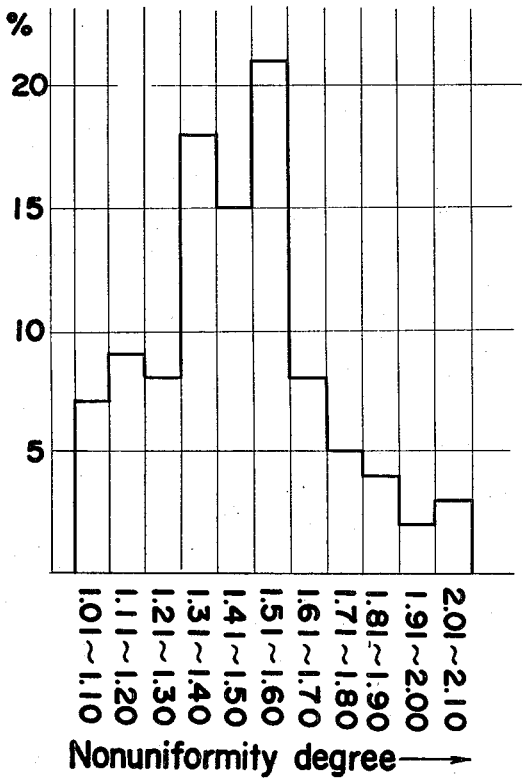
FIG. 3 Prior Art
FIG. 3 is a chart showing the distributions of the degrees of nonuniformity of coating film formed by the conventional apparatus of FIG. 1.
Figure 13:
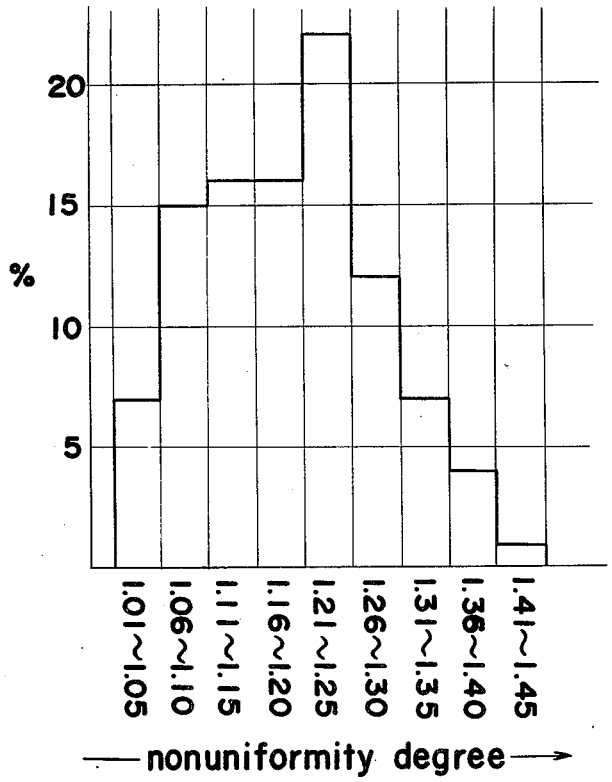
FIG. 13 is a chart showing distributions of degrees of nonuniformity of coating film formed by the coating apparatus of the present invention.

Referring to the charts of FIGS. 13 to 14(*b*), according to a series of experiments carried out by the present inventors, when the fixed radial bearing 10 directly related to the present invention is provided as described earlier, an average value $\bar{x}$ of 1.19 for the coating solution application nonuniformity degree was obtained, with a standard deviation $3\delta$ of 0.28 as shown in a chart of FIG. 13; whereas in the conventional arrangement, the average value $\bar{x}$ was 1.46, with standard deviation $3\delta$ of 0.71 as described earlier with reference to FIG. 3. When it is taken into account that a similar average value for the perfectly uniform coating solution application is 1, the remarkable effect according to the arrangement of the present invention can clearly be seen. Furthermore, when the contacting-terminating and initiating positions C1 and C2 between the wire 2 and the pulleys P1 and P2 are caused to vibrate at a half amplitude of 0.7 mm and at the number of vibrations or frequency of 60 Hg, the conventional arrangement gave results such as an average nonuniformity degree value $\bar{x}$ of 1.8 and a standard deviation $3\delta$ of 1.21 as shown in FIG. 14(*a*); while, upon provision of the radial bearing 10 in the above conventional arrangement, marked improvements were noticed with average nonuniformity degree value $\bar{x}$ of 1.29 and standard deviation $3\delta$ of 0.37 as shown in FIG. 14(*b*). Accordingly, even when the diameter of the wire 2 to be coated is varied to a certain extent, the pulleys P1 and P2 need not be replaced if the pulleys P1 and P2 are provided with large pulley grooves.

It should be noted here that the cross section of the material to be coated is not limited to a circular shape, but may be any other shapes such as elliptical, triangular, rectangular or polygonal shapes, H should be further noted that the coating solution is not necessarily of polyvinyl formal and polyester, but may be any other fluids having viscosity.

It is also to be noted that the radial bearing need not necessarily be incorporated within the coating solution applying bath, but may be at any other place provided that the radial bearing is positioned in the vicinity of the floating die.

It is further noted that it is sufficient for the radial bearing to be lubricated to such an extent as will not give damage to the surface of the material to be coated due to sliding contact between such material and the bearing surface of the radial bearing, and that the lubricating material is not limited to the coating solution to be applied, but may be any other suitable material separately employed as the lubricating material.

Furthermore, it should be noted that, although the radial bearing as described with reference to FIG. 9 utilizing the wedge action effect due to relative motion between the same bearing and the material to be coated can advantageously be employed in the arrangement of the present invention because of its simple construction, radial bearings of other constructions, for example, a static pressure type forced lubrication bearing, may be employed.

Figure 15:
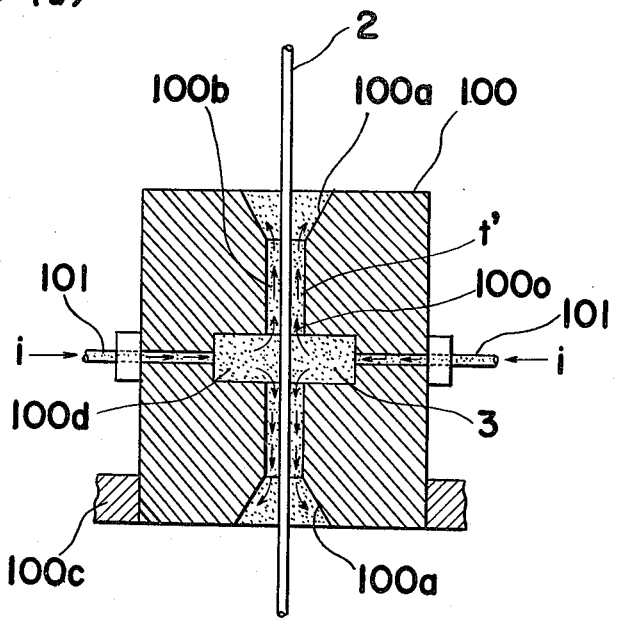
FIG. 15(*a*) is a schematic sectional view of a static pressure type forced lubricating radial bearing which is a modification of the radial bearing of the present invention of FIG. 9.
Figure 15:
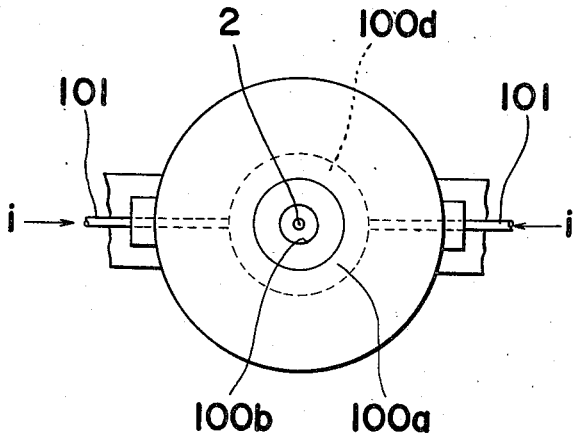
Figure 15:
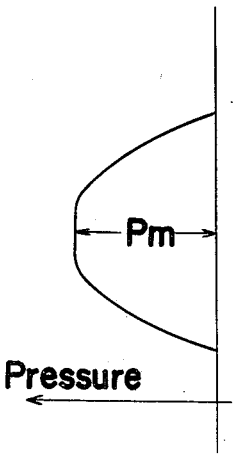

Referring to FIGS. 15(*a*) to 15(*c*), there is shown a modification of the arrangement of FIGS. 8 and 9. In this modification, the wedge action effect type radical bearing 10 described as employed in the arrangement of FIGS. 8 and 9 is replaced by a static pressure type forced lubrication bearing 100. In FIG. 15(*a*), the floating die 4 and the container 1 are removed for brevity of description. The bearing 100 has a central through-opening 100*o* through which the wire 2 to be coated is passed and which includes conical tapered portions 100*a* formed in the opposite surfaces of the bearing 100 and a cylindrical narrowed portion 100*b* connecting the tapered portions 100*a*. A circular chamber or a kind of accumulator 100*d* is formed at the central portion in the bearing 100 so as to be communicated with the tapered portions 100*a* through the cylindrical narrowed portion 100*b* of the through-opening 100*o*, with the accumulator 100*d* being communicated with inlet openings 101 formed in a side wall of the bearing 100 in directions normal to the advancing direction of the wire 2. The bearing 100 is suitably secured to the coating solution application bath or container (not shown) through the support plate 100*c* in a manner similar to the radial bearing 10 in FIGS. 8 and 9.

By the above arrangement, the coating solution 3, also serving as lubricant and pressurized, for example, by a compressor, is introduced into the bearing 100 through the inlet openings 101 in the direction indicated by the arrow i. The coating solution 3 thus introduced into the bearing 100 is once pooled in the accumulator 100*d* which is provided to improve axial symmetry of the pressure, and is subsequently discharged through the clearance t' formed between the wire 2 and the cylindrical narrowed portion 100*b* of the opening 100*o*. At this time, the pressure of the coating solution 3 which also serves as the lubricant on the bearing surface at the cylindrical narrowed portion 100*b* of the radial bearing 100 is as shown in FIG. 15(*c*), by which pressure, the coaxial relation between the bearing surface at the portion 100*b* and the wire 2 is maintained. It is to be noted that, when the static pressure type forced lubrication radial bearing 100 is employed, the peak pressure Pm as shown in FIG. 15(*c*) can be set to any desired value through control of the pressurization by the compressor (not shown), and thus a strong bearing effect can advantageously be obtained.

Although the present invention has been fully described by way of example with reference to the attached drawings, it is to be noted that various changes and modifications are apparent to those skilled in the art. Therefore, unless such changes and modifications depart from the scope of the present invention they should be construed as included therein.

What is claimed is:

1. A coating apparatus for applying a coating solution on to a material to be coated passing therethrough, said apparatus comprising:

a container containing said coating solution therein;

floating die member means within said container and having an opening therethrough for allowing said material to be coated to pass therethrough after it passes through said coating solution; and radial bearing member means in a position in said container prior to said floating die member means with respect to the direction of movement of said material to be coated, said bearing member means having a through hole through which said material to be coated passes said radial bearing member means being comprised of a static pressure type forced lubricating bearing that maintains the material coaxial of the said though hole.

2. An apparatus as claimed in claim 1, wherein:

said coating solution is pressurized in said container;

said radial bearing member means has at least one inlet opening therethrough communicating with its bearing surface, whereby said coating solution, after pressurization, is supplied through said inlet opening into the clearance between said bearing surface and said material to be coated passing therethrough.

3. An apparatus as claimed in claim 1, wherein said radial bearing member means is fixed to said container.

* * * * *